US009595168B2

(12) United States Patent
Shankar et al.

(10) Patent No.: US 9,595,168 B2
(45) Date of Patent: Mar. 14, 2017

(54) ONLINE SOCIAL GAMING WITH INCENTIVES

(71) Applicant: RealNetworks, Inc., Seattle, WA (US)

(72) Inventors: Namitta Shankar, Seattle, WA (US); Joseph Leighton Wade Boutilier, Victoria (CA); Jared Michael Brinkley, Seattle, WA (US)

(73) Assignee: RealNetworks, Inc., Seattle, WA (US)

( * ) Notice: Subject to any disclaimer, the term of this patent is extended or adjusted under 35 U.S.C. 154(b) by 142 days.

(21) Appl. No.: 13/931,367

(22) Filed: Jun. 28, 2013

(65) Prior Publication Data

US 2015/0005060 A1 Jan. 1, 2015

(51) Int. Cl.
*G07F 17/32* (2006.01)

(52) U.S. Cl.
CPC ..... *G07F 17/329* (2013.01); *G07F 17/3218* (2013.01); *G07F 17/3239* (2013.01); *G07F 17/3274* (2013.01)

(58) Field of Classification Search
CPC ..... G07F 17/323; G07F 17/3274
USPC ..... 463/26, 29
See application file for complete search history.

(56) References Cited

U.S. PATENT DOCUMENTS

| | | | | |
|---|---|---|---|---|
| 8,491,376 | B1 * | 7/2013 | Di Carlo | 463/20 |
| 2003/0050806 | A1 * | 3/2003 | Friesen et al. | 705/5 |
| 2007/0259709 | A1 * | 11/2007 | Kelly et al. | 463/20 |
| 2009/0172035 | A1 * | 7/2009 | Lessing et al. | 707/104.1 |
| 2009/0191962 | A1 * | 7/2009 | Hardy et al. | 463/29 |
| 2009/0197684 | A1 * | 8/2009 | Arezina et al. | 463/42 |
| 2011/0081958 | A1 * | 4/2011 | Herrmann et al. | 463/16 |
| 2011/0092267 | A1 * | 4/2011 | Hardy et al. | 463/17 |
| 2011/0294561 | A1 * | 12/2011 | Shaw et al. | 463/20 |
| 2012/0058808 | A1 * | 3/2012 | Lockton | 463/9 |
| 2012/0202587 | A1 * | 8/2012 | Allen et al. | 463/25 |
| 2013/0040730 | A1 * | 2/2013 | Barclay et al. | 463/27 |
| 2013/0116042 | A1 * | 5/2013 | Mosley et al. | 463/26 |
| 2013/0244765 | A1 * | 9/2013 | Arnone et al. | 463/25 |
| 2014/0274363 | A1 * | 9/2014 | Massing et al. | 463/29 |

* cited by examiner

*Primary Examiner* — Michael Cuff
(74) *Attorney, Agent, or Firm* — AEON Law; Adam L.K. Philipp

(57) ABSTRACT

A game platform can distinguishes between users in different jurisdictions, can offer eligible players the choice of playing games with the opportunity to enter sweepstakes for monetary and non-monetary rewards, and allows heterogeneous users—those eligible as well as ineligible for monetary reward—to participate in game activity as part of teams.

20 Claims, 11 Drawing Sheets

ONLINE SOCIAL GAMING WITH INCENTIVES

FIELD

This disclosure relates to a method and system for playing online games with a social aspect and the opportunity to earn monetary and non-monetary rewards.

BACKGROUND

The following description includes information that may be useful in understanding the present invention. It is not an admission that any of the information provided herein is prior art or relevant to the presently claimed invention, or that any publication specifically or implicitly referenced is prior art.

Due to legal and social distinctions, online sweepstakes are separated between sweepstakes in which money can be won and sweepstakes in which only non-monetary rewards can be achieved (such as points toward more game-play). Some jurisdictions are beginning to allow online sweepstakes in which money can be won, while other jurisdictions retain laws which prohibit this.

DETAILED DESCRIPTION

Figure 1:
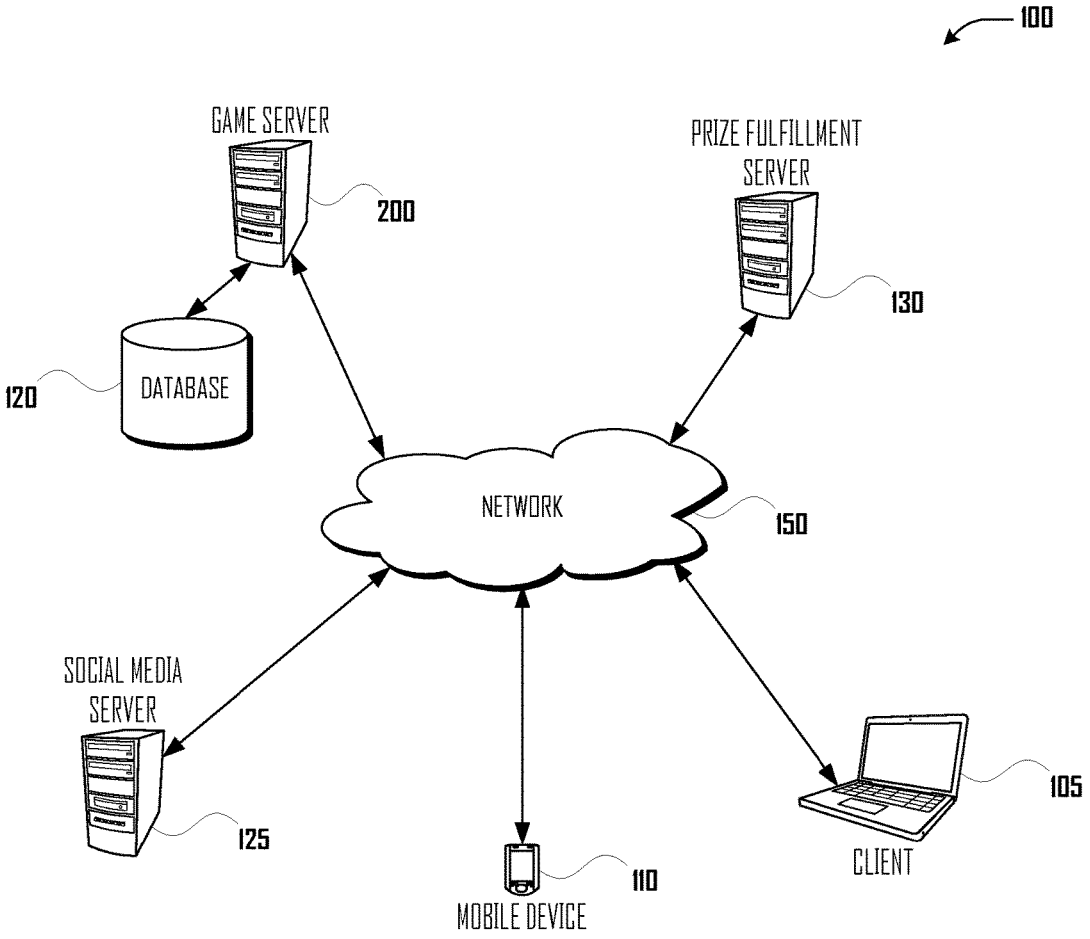
FIG. 1 is a network and device diagram illustrating exemplary computing devices configured according to embodiments disclosed in this paper.

The following Detailed Description provides specific details for an understanding of various examples of the technology. One skilled in the art will understand that the technology may be practiced without many of these details. In some instances, structures and functions have not been shown or described in detail or at all to avoid unnecessarily obscuring the description of the examples of the technology. It is intended that the terminology used in the description presented below be interpreted in its broadest reasonable manner, even though it is being used in conjunction with a detailed description of certain examples of the technology. Although certain terms may be emphasized below, any terminology intended to be interpreted in any restricted manner will be overtly and specifically defined as such in this Detailed Description section.

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." As used herein, the term "connected," "coupled," or any variant thereof means any connection or coupling, either direct or indirect between two or more elements; the coupling of connection between the elements can be physical, logical, or a combination thereof. Additionally, the words, "herein," "above," "below," and words of similar import, when used in this application, shall refer to this application as a whole and not to particular portions of this application. When the context permits, words using the singular may also include the plural while words using the plural may also include the singular. The word "or," in reference to a list of two or more items, covers all of the following interpretations of the word: any of the items in the list, all of the items in the list, and any combination of one or more of the items in the list.

Certain elements appear in various of the Figures with the same capitalized element text, but a different element number. When referred to herein with the capitalized element text but with no element number, these references should be understood to be largely equivalent and to refer to any of the elements with the same capitalized element text, though potentially with differences based on the computing device within which the various embodiments of the element appears.

As used herein, "Game" refers to games involving wagers and chance, such as card games (including poker, blackjack), dice, roulette, slot machines, and similar. Games may include strategy and skill, in addition to chance. The amount of the wager may be set before the Game is played, such as slot machines which charge an amount (a wager) to play (a twenty-five cent slot machine). The amount of the wager may include a monetary amount (including a credit representing money) or a non-monetary amount, such as a credit not representing money. The Games may be played in a computer interface which simulates or approximates the odds of the game when played in a physical media (such as "video poker" or "video slots," which approximate the odds of playing poker or a slot machine). As used herein, "Sweepstakes" refers to a lottery or drawing for a reward from among a group of participants. Apart from entry into a Sweepstakes, Sweepstakes do not involve a wager, strategy, or skill.

Generally, the game platform disclosed herein can distinguish between users in different jurisdictions, can offer eligible players the choice of playing games with the opportunity to enter sweepstakes for monetary and non-monetary rewards, and allows heterogeneous users—those eligible as well as ineligible for monetary reward—to participate in game activity as part of teams.

FIG. 1 is a network and device diagram illustrating exemplary computing devices configured according to embodiments disclosed in this paper. Illustrated in FIG. 1 are a Game Server 200, a Prize Fulfillment Server 130, a Client Device 105 and a Mobile Device 110 (referred to individually or together as a "Client Device"), and a Social Media Server 125. Generally, a Client Device, whether Client Device 105 and/or Mobile Device 110, interacts with a User Contact Routine 500 executed by the Game Server 200. The User Contact Routine 500 executed by the Game Server 200 provides a user interface to the Client Device, which User Contact Routine 500 executes an Eligibility Routine 600 to determine the eligibility of a user of the Client Device to participate in Sweepstakes for monetary or non-monetary rewards, executes a Game Play Routine 700 to allow users to play games and earn Sweepstakes tokens, executes a Ticket Award Routine 800 to award Sweepstakes tokens, executes a Team Routine 900 to allow the user of a Client Device to participate in teams to complete a team challenge to earn Sweepstakes tokens, executes a Sweepstakes Entry Routine 1000 to enter users in Sweepstakes, and executes a Sweepstakes Routine 1100 to determine final eligibility of and award Sweepstakes winners.

In FIG. 1, the Game Server 200, Prize Fulfillment Server 130, and Social Media Server 125 are illustrated as separate computers and modules; these may be physically separate computing devices or logically separate processes executed by a common computing device (including a common computing device executed across multiple hardware components).

The Client Device 105 and Mobile Device 110 are illustrated in FIG. 1 as examples of computing devices used by individuals and referred to generally herein as a "Client Device" or as "Client Devices." The Client Device 105 may be, for example, a personal computer, a gaming computer, a laptop computer, a desktop computer, or similar. The Mobile Device 110 may be, for example, a mobile phone, a smartphone, a tablet computer, a wearable computer, or similar. Client Devices are used by "users."

The Social Media Server 125 illustrated in FIG. 1 may be any computer which provides social media services such as, for example, Facebook, Google+, Twitter, and other services which allow registered users to communicate within a network of registered users. The Network 150 illustrated in FIG. 1 comprises computers, network connections among the computers, and software routines to enable communication between the computers over the network connections. Examples of the Network 150 comprise an Ethernet network, the Internet, and/or a wireless network, such as a GSM, TDMA, CDMA, EDGE, HSPA, LTE, LTE-Advanced or other network provided by a wireless service provider. Connection to the Network 150 may be via a wireless or wireline connection. More than one network may be involved in a communication session between the illustrated devices. Connection to the Network 150 may require that the computers execute software routines which enable, for example, the seven layers of the OSI model of computer networking or equivalent in a wireless phone network.

This paper may discuss a first computer as connecting to a second computer (such as a Client Device connecting to the Game Server 200) or to a corresponding datastore (such as to Game Server Datastore 300); it should be understood that such connections may be to, through, or via the other of the two components (for example, a statement that a Client Device connects with or sends data to the Game Server 200 should be understood as saying that the computing device may connect with or send data to the Game Server Datastore 300). References herein to "database" should be understood as equivalent to "Datastore." Although illustrated as components integrated in one physical unit, the computers and databases may be provided by common (or separate) physical hardware and common (or separate) logic processors and memory components. Though discussed as occurring within one computing device, the software routines and data groups used by the software routines may be stored and/or executed remotely relative to any of the computers through, for example, application virtualization.

Figure 2:
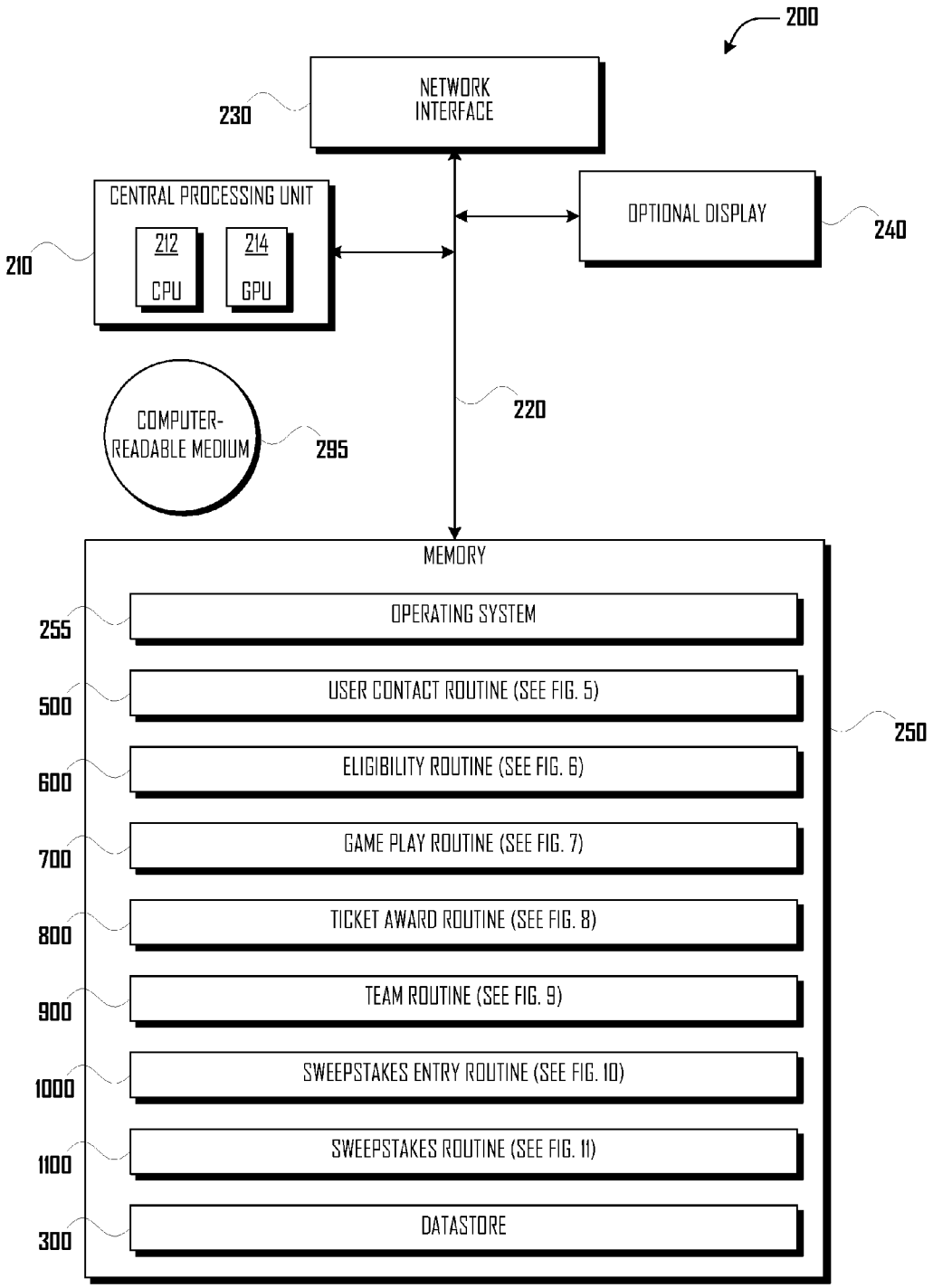
FIG. 2 is a functional block diagram of an exemplary Game Server computing device and some data structures and/or components thereof.

FIG. 2 is a functional block diagram of an exemplary Game Server computing device and some data structures and/or components thereof. The Game Server 200 in FIG. 2 comprises at least one Processing Unit 210, Game Server Memory 250, a Display 240 and Input 245, all interconnected along with the Network Interface 230 via a Bus 220. The Processing Unit 210 may comprise one or more general-purpose Central Processing Units ("CPU") 212 as well as one or more special-purpose Graphics Processing Units ("GPU") 214. The components of the Processing Unit 210 may be utilized by the Operating System 255 for different functions required by the routines executed by the Game Server 200. The Network Interface 230 may be utilized to form connections with the Network 150 or to form device-to-device connections with other computers. The Game Server Memory 250 generally comprises a random access memory ("RAM"), a read only memory ("ROM"), and a persistent mass storage device, such as a disk drive or SDRAM (synchronous dynamic random-access memory). The Game Server Memory 250 stores program code for software routines, such as, for example, a User Contact Routine 500, an Eligibility Routine 600, a Game Play Routine 700, a Ticket Award Routine 800, a Team Routine 900, a Sweepstakes Entry Routine 1000 routine, and a Sweepstakes Routine 1100 routine, as well as, for example, browser, email client and server routines, client applications, and database applications (discussed further below). Additional data groups for routines, such as for a webserver and web browser, may also be present on and executed by the Game Server 200. Webserver and browser routines may provide an interface for interacting with the other computing devices illustrated in FIG. 1 or with other computing devices not illustrated in FIG. 1, for example, through webserver and web browser routines (which may serve and respond to data and information in the form of webpages and html documents or files). The browsers and webservers are meant to illustrate user-interface and user-interface enabling routines generally, and may be replaced by equivalent routines for serving and rendering information to and in a user interface in a computing device (whether in a web browser or in, for example, a mobile device application).

In addition, the Game Server Memory 250 also stores an Operating System 255. These software components may be loaded from a non-transient Computer Readable Storage Medium 295 into Game Server Memory 250 of the computing device using a drive mechanism (not shown) associated with a non-transient Computer Readable Storage Medium 295, such as a floppy disc, tape, DVD/CD-ROM drive, memory card, or other like storage medium. In some embodiments, software components may also or instead be loaded via a mechanism other than a drive mechanism and Computer Readable Storage Medium 295 (e.g., via Network Interface 230).

The Media Server 200 may also comprise hardware supporting input modalities, Input 245, such as, for example, a touchscreen, a camera, a keyboard, a mouse, a trackball, a stylus, motion detectors, and a microphone. The Input 245 may also serve as a Display 240, as in the case of a touchscreen display which also serves as Input 245, and which may respond to input in the form of contact by a finger or stylus with the surface of the Input 245.

Figure 3:
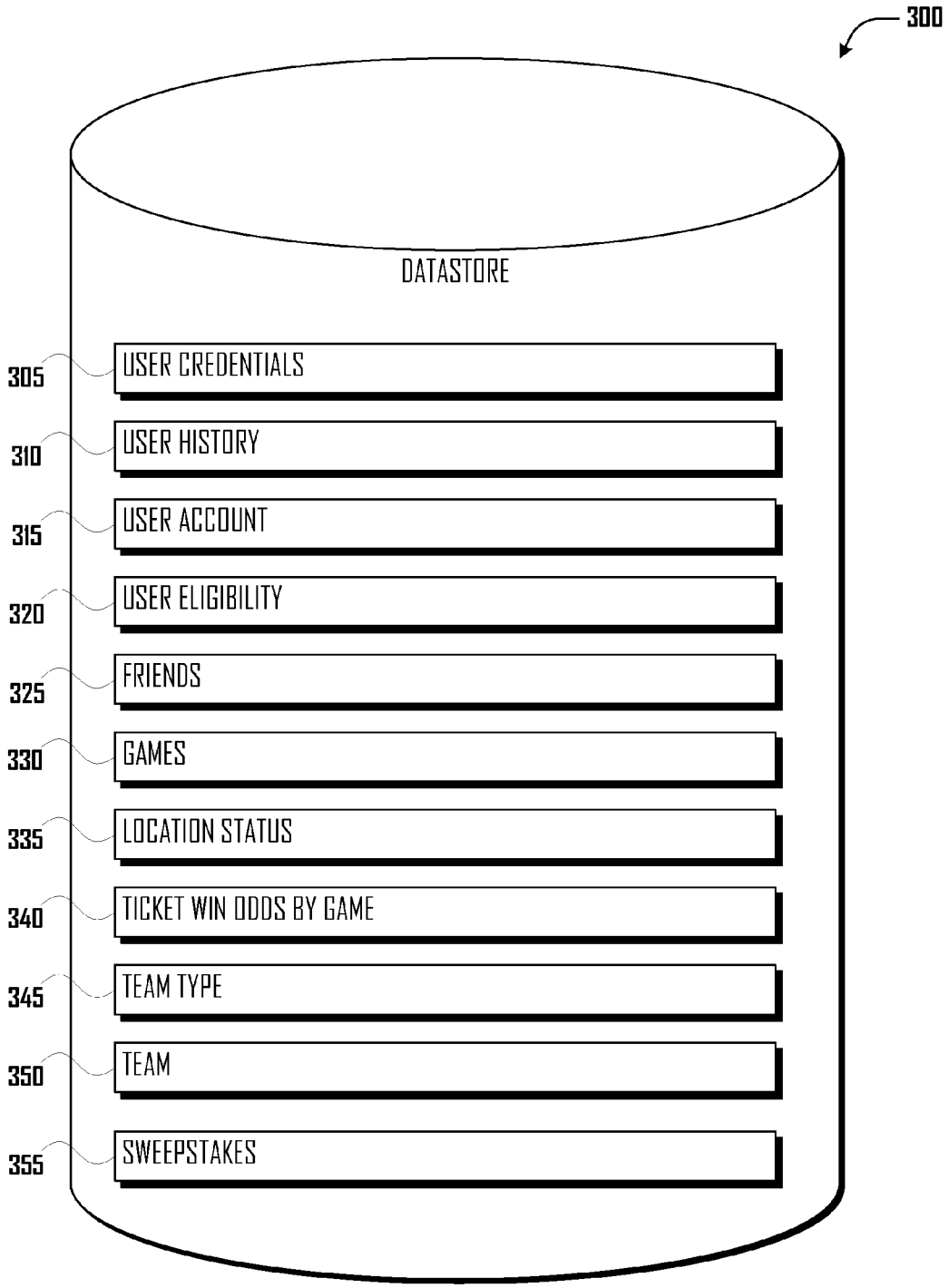
FIG. 3 is a functional block diagram of the Game Server Datastore illustrated in the computing device of FIG. 2.

The Game Server 200 may also comprise or communicate via Bus 220 with Game Server Datastore 300, illustrated further in FIG. 3. In various embodiments, Bus 220 may comprise a storage area network ("SAN"), a high speed serial bus, and/or via other suitable communication technology. In some embodiments, the Game Server 200 may communicate with the Game Server Datastore 300 via Network Interface 230. The Game Server 200 may, in some embodiments, include many more components than those shown in this Figure. However, it is not necessary that all of these generally conventional components be shown in order to disclose an illustrative embodiment.

FIG. 3 is a functional block diagram of the Game Server Datastore illustrated in the computing device of FIG. 2. The components of the Game Server Datastore 300 are data groups used by routines and are discussed further herein in the discussion of other of the Figures.

The data groups used by routines illustrated in FIG. 3 may be represented by a cell in a column or a value separated from other values in a defined structure in a digital document or file. Though referred to herein as individual records or entries, the records may comprise more than one database entry. The database entries may be, represent, or encode numbers, numerical operators, binary values, logical values, text, string operators, joins, conditional logic, tests, transformations, and similar.

The User Credentials 305 may comprise entries indicating, for example, some or all of the following: a login identifier and password, whether a two-factor identification system is used with respect to the user, and similar credentials for a social media service, such as at Social Media Server 125.

The User History 310 records may comprise entries indicating, for example, some or all of the following: the Games the user has played, when the user played the Games, bets or wagers the user made in Games, winnings and/or losses of the user in the Games, Sweepstakes offered to and/or accepted by the user, when, and whether the user won the Sweepstakes.

The User Account 315 may comprise entries indicating, for example, some or all of the following: a number of credits or dollars remaining in or available to the user's account, a type of user account, and contact information for the user.

The User Eligibility 320 records may comprise entries indicating, for example, some or all of the following: the user's eligibility to play Games and/or enter Sweepstakes for monetary and/or non-monetary rewards, the basis for the eligibility categorization, locations associated with the user, and how the locations associated with the user were obtained (such as from manual entry into a form, from an IP address, from a GPS service, or similar).

The Friends 325 records may comprise entries indicating, for example, some or all of the following: friends the user has in social media services and/or in the system disclosed herein.

The Games 330 records may comprise entries indicating, for example, some or all of the following: Games which users may play, the rules of play, program code for an interface for a Game, and the like.

The Location Status 335 records may comprise entries indicating, for example, some or all of the following: the jurisdictional rules found in different locations relative to Game play, participation in Game play for monetary and non-monetary awards, and the like.

The Ticket Win Odds by Game 340 records may comprise entries indicating, for example, some or all of the following: the odds of winning a Ticket (described herein as a token for entering a Sweepstakes) with respect to different Games 330 and with respect to gameplay with the different Games 330.

The Team Type 345 records may comprise entries indicating, for example, some or all of the following: different types of Teams, with different rules for Team participation and the distribution of Team assets, such as "Coins" and monetary and non-monetary rewards.

The Team 350 records may comprise entries indicating, for example, some or all of the following: Teams, Team names, Team members, dates and times, and Team Types 345; these records may further indicate which users have joined or been invited to join particular teams of Team Types 345.

Figure 4:
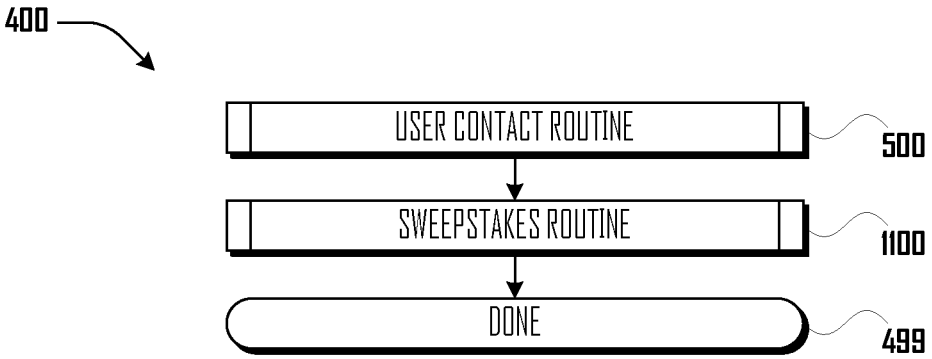
FIG. 4 is a flowchart illustrating an overview of execution of a User Contact Routine, through which the Game Server interacts with a Client Device, and a Sweepstakes Routine.

FIG. 4 is a flowchart illustrating an overview of execution of a User Contact Routine 400, as may be performed by the Game Server 200 in accordance with one embodiment, and a Sweepstakes Routine 1100. At block 500, routine 400 executes the User Contact Routine 500 (illustrated further in FIG. 5). At block 1100, routine 400 executes a Sweepstakes Routine 1100 process (illustrated further in FIG. 10) to determine final eligibility of and award Sweepstakes winners. Routine 400 ends at block 499.

Figure 5:
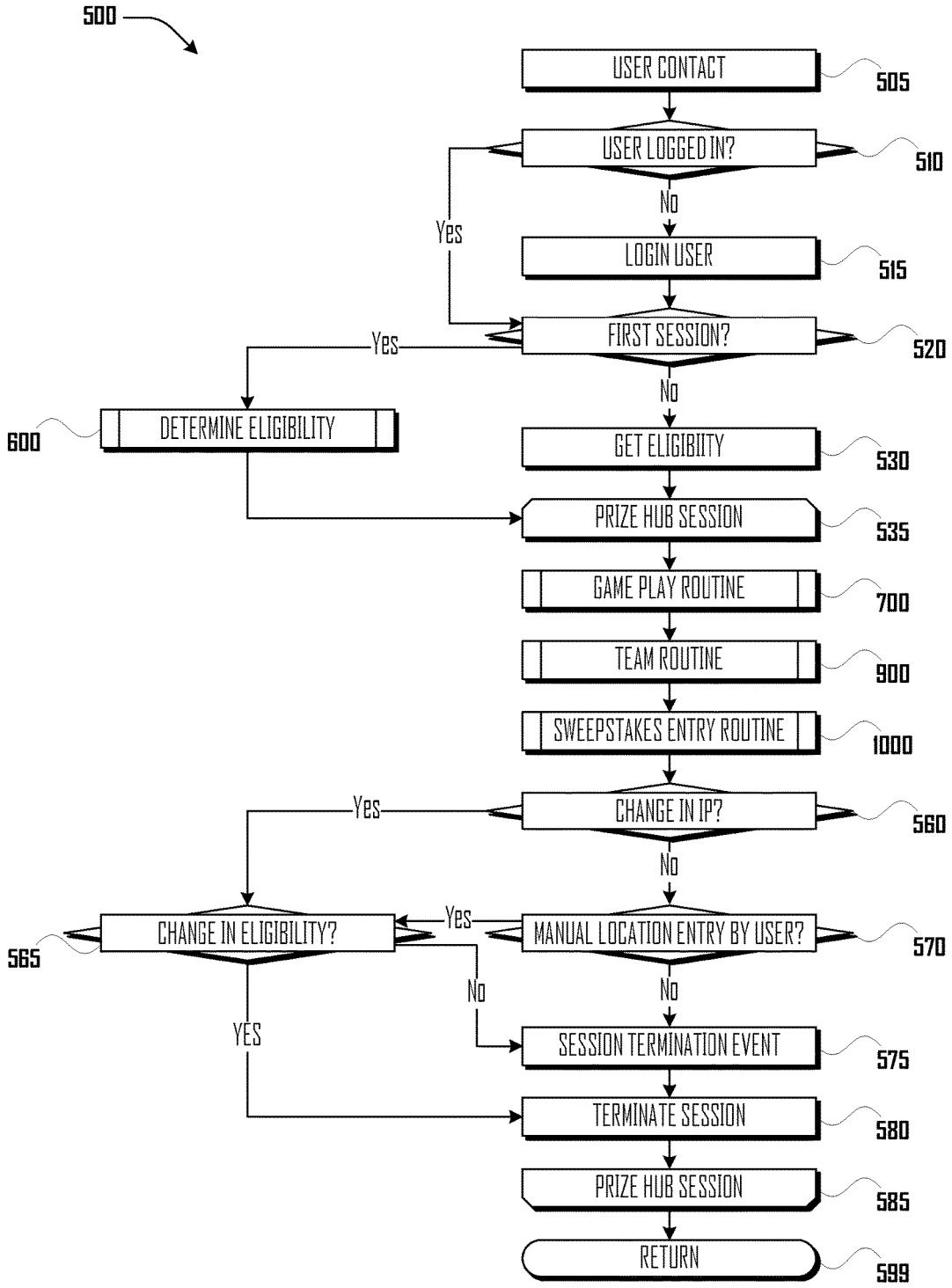
FIG. 5 is a flowchart illustrating a detail of the User Contact Routine illustrated in FIG. 4.

FIG. 5 is a flowchart illustrating a detail of the User Contact Engine routine illustrated in FIG. 4, as may be performed by, for example, the Game Server 200. Generally, the User Contact Routine 500 provides a user interface to the Client Device, which User Contact Routine 500 executes an Eligibility Routine 600 to determine the eligibility of a user of the Client Device to participate in Sweepstakes and/or Games for monetary or non-monetary rewards, executes a Game Play Routine 700 to allow users to play games and earn Sweepstakes tokens, executes a Ticket Award Routine 800 to award Sweepstakes tokens, executes a Team Routine 900 to allow the user of the Client Device to participate in teams to complete a team challenge to earn Sweepstakes tokens, and executes a Sweepstakes Entry Routine 1000 to enter users in Sweepstakes.

At block 505, a server, such as the Game Server 200, may receive a user contact. Some or all of the user interface for the user contact may be provided to a web browser or application executed on a Client Device. The user contact may be received via a web browser or an application executed on a Mobile Device 110 or another Client Device. Block 510 illustrates a decision regarding whether the user of the user contact of block 505 is logged in to the User Contact Routine 500. Logging in may comprise having created an account, such as User Account 315, with the User Contact Routine 500 and having established login credentials, such as a user-name and password or login credentials in a social media service such as Facebook®, available from, for example, Social Media Server 125. The user's logged in status may be obtained by, for example, checking a cookie on or of the Client Device and/or checking the user's logged in status relative to the Social Media Server 125. If the user is logged in, then the routine may proceed to block 520; if the user is not logged in, then the routine may proceed to block 515, in which the user is asked to provide login credentials (and, if necessary, to create an account).

At block 520 a determination may be made regarding whether this is the first logged-in session of the user with the User Contact Routine 500, a session also being referred to herein as a Prize Hub Session. If it is the first session, then at block 600, illustrated further in FIG. 6, the user's eligibility with respect to different Games and/or monetary or non-monetary prizes in Games or Sweepstakes may be determined. If it is not the first session, then at block 530 the user's eligibility may be obtained, for example, from the User Eligibility 320 records. The user's eligibility determines components of the user interface served by the User Contact Routine 500, such as Games, prizes, Sweepstakes, and similar which may be available depending on eligibility. For example, if the user is determined to be eligible to participate in Sweepstakes for monetary prizes, then the user interface may contain elements communicating the available monetary and non-monetary prizes, whereas if the user is determined to be eligible to participate in Sweepstakes only for non-monetary prizes, then the user interface may contain elements communicating the available non-monetary prizes ("Coins") as well as providing alternative ways for the user to demonstrate eligibility for monetary prizes. Eligibility at step 530 may also be confirmed such as, for example, according to blocks 605 through 699.

Blocks 535 through 585 may iterate a Prize Hub Session for the eligibility determined at block 600 or obtained at block 530. Optionally, a Prize Hub Session may be for a bounded period of time, such as a 24 hour or 10 hour period of time. The time period may be measured relative to the user contact at block 505, relative to a logging-in event, relative to the loading of a game screen, or relative to an independent (external) time standard; the period of time may conclude when the user leaves a webpage, shuts down the user's computer hardware, and/or manually refreshes the interface or as otherwise discussed in relation to block 575 and events which terminate the Prize Hub Session.

Figure 7:
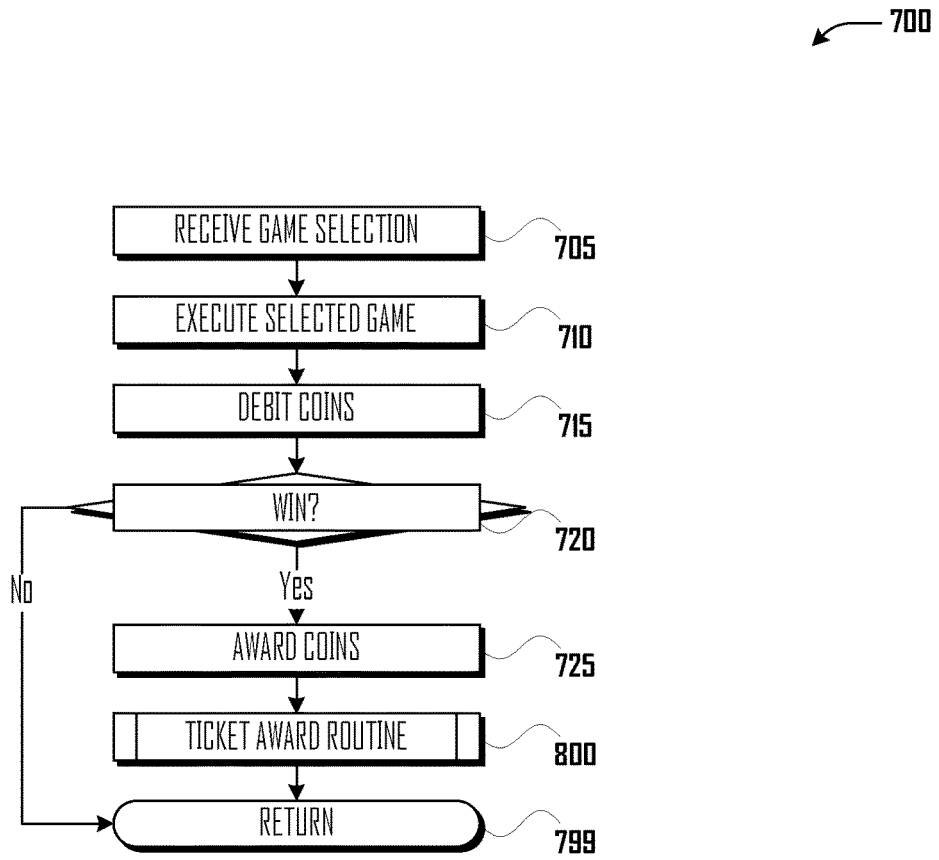
FIG. 7 is a flowchart illustrating a detail of a Game Play Routine, as may be practiced within the User Contact Routine 500 illustrated in FIG. 5.
Figure 9:
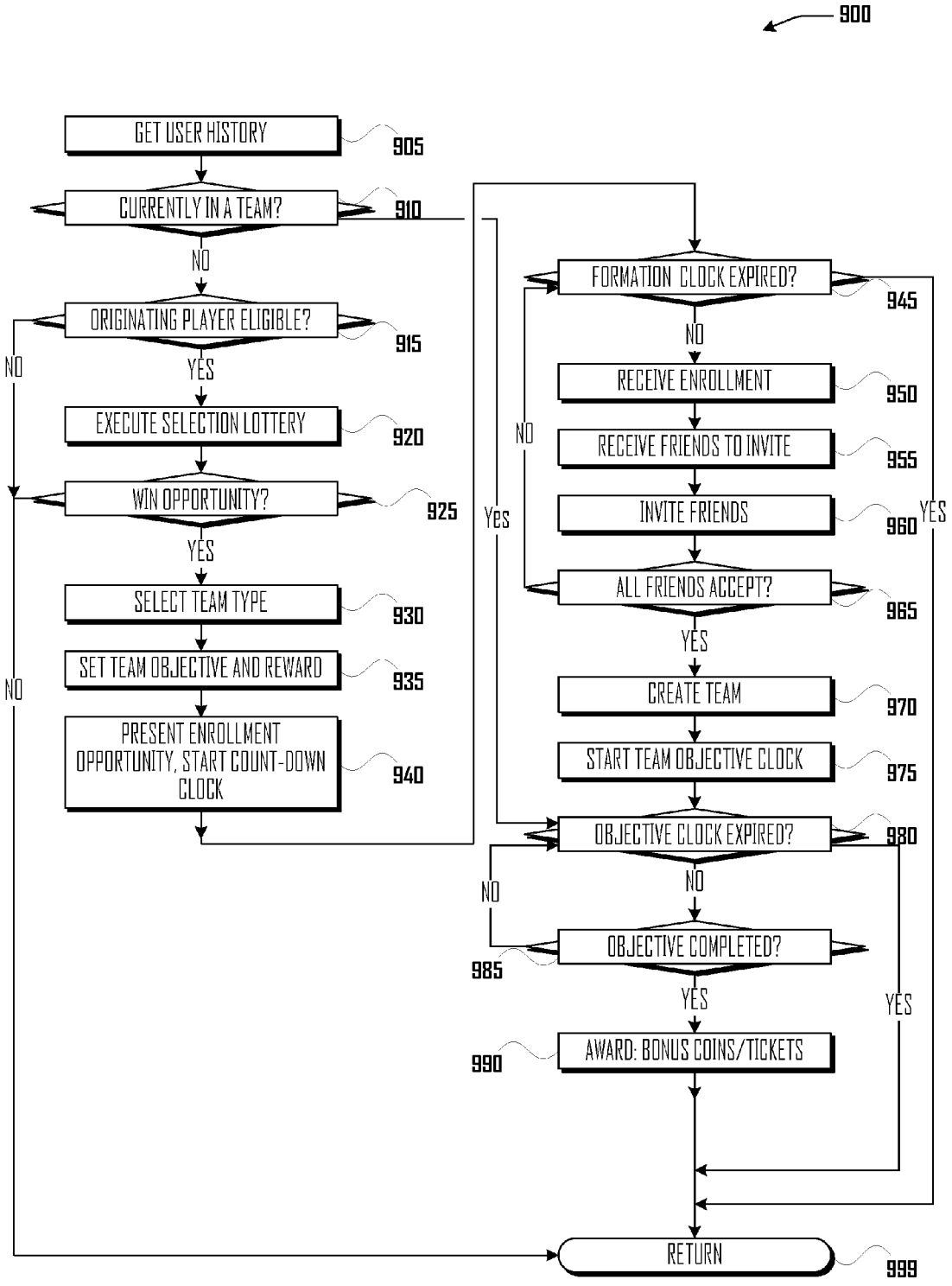
FIG. 9 is a flowchart illustrating a detail of a Team Routine, as may be practiced within the User Contact Routine 500 illustrated in FIG. 5.
Figure 10:
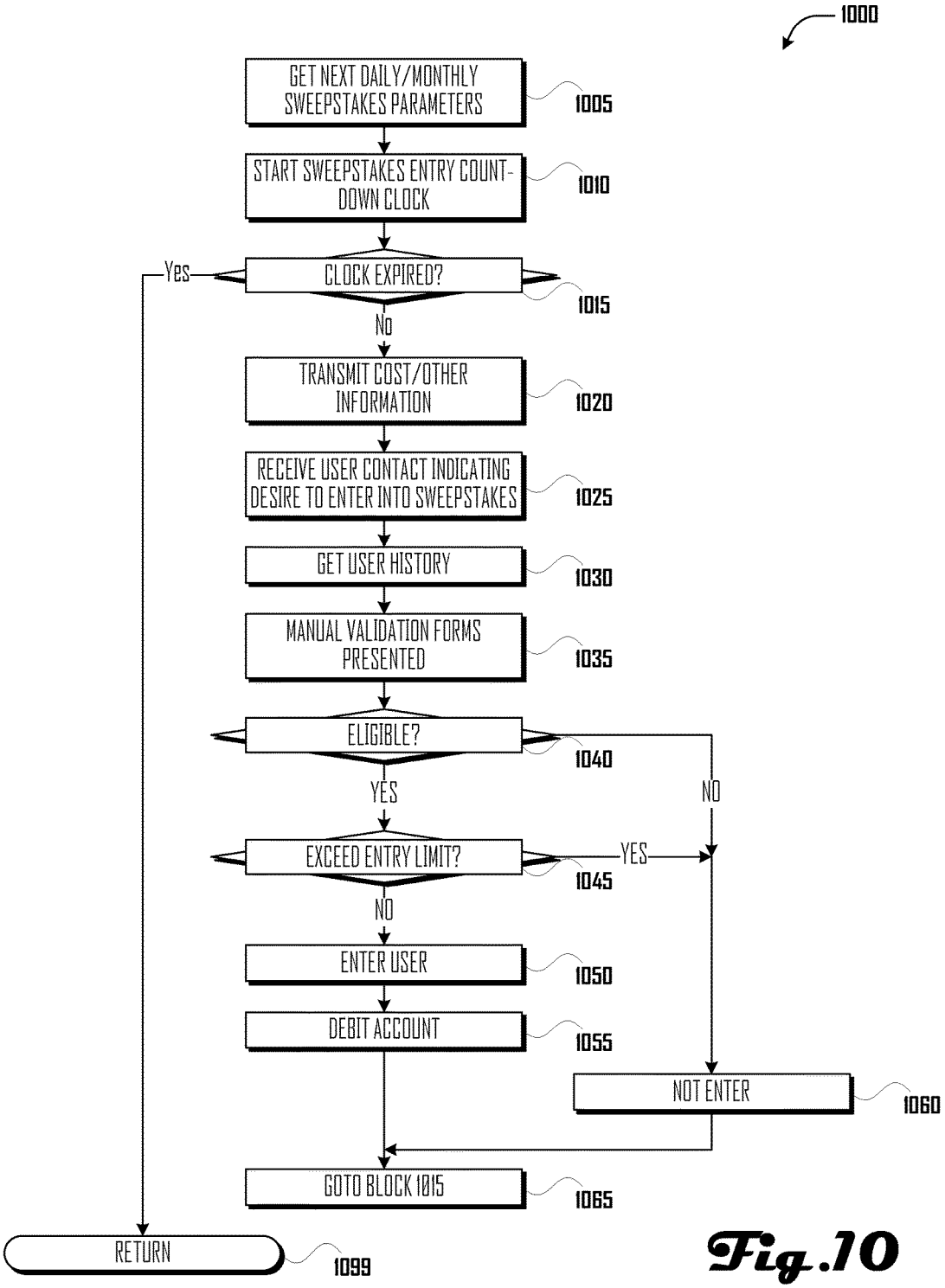
FIG. 10 is a flowchart illustrating a detail of the Sweepstakes Entry Routine, illustrated in FIG. 5.

Within a Prize Hub Session, the user may play Games, may enter Teams, and may enter Sweepstakes; processes implementing these activities are illustrated as the Game Play Routine 700, discussed further in relation to FIG. 7, the Team Routine 900, discussed further in relation to FIG. 9, and the Sweepstakes Entry Routine 1000, discussed further in relation to FIG. 10. These routines are illustrated in serial in FIG. 5, though these routines may be implemented in parallel or in an order different than that illustrated in FIG. 5. The user may enter multiple Games, may enter or attempt to enter or form multiple Teams, and may enter or attempt to enter multiple Sweepstakes.

Interaction with the user interface may provide the user with information regarding the user's account, such as a number of credits which may be used to enter Games, a number of credits earned by Game play, a number of tokens in the user's account, a number of tokens required to enter Sweepstakes, contact information for the user, the user's eligibility, Teams which the user is participating in toward Team Challenges, user and Team progress toward Challenges, available Games which the user can play, available Sweepstakes which the user may enter, and similar. Information for this user interface may come from, for example, the User Account 315, User History 310, User Eligibility 320, and Team 350 records in the Game Server Datastore 300. Blocks 700, 900, and 1000 represent some (though not all) of the ways the user may interact with the user interface.

During the Prize Hub Session (between blocks 535 and 585), the User Contact Routine 500 may, at block 560 detect a change in the IP address ("Internet Protocol address") utilized by the Client Device. The IP address may change, for example, if the user switches Client Devices, if the user physically moves (such as if the user is utilizing Mobile Device 110) and the user's network connection changes, or if the user switches Internet Service Providers (with or without physically moving) and is assigned a new IP address. If there has been a change in IP address, then at block 565 a determination may be made regarding whether the new IP address indicates a change in eligibility, such as whether the new IP address is a jurisdiction with different eligibility rules. For example, the user may be detected to switch from a first IP address to a second IP address; the first and second IP addresses may be looked up, for example in the Location Status 335 records to determine a location associated with the IP address and to determine if the determined location is eligible or ineligible for monetary rewards. If there was a change in eligibility, such as if the user's eligibility went from being eligible to participate in Sweepstakes for monetary rewards to being eligible to participate in Sweepstakes only for non-monetary rewards ("Coins"), then at block 580 the then-current Price Hub Session may be terminated. If, at block 560, there was no change in IP address, then at block 570, the user may optionally be given an opportunity to manually enter the user's location. The user may presented with this option if, for example, the user had previously been determined to be eligible only for non-monetary rewards. This option may be presented regardless of whether or not (or even if) a change in IP address is detected. If the user manually enters a location at block 570, then the process may proceed to block 565 and a determination regarding whether the manually entered location has eligibility which is different from that which previously applied to the user. If there was no change in eligibility determined at block 565 or if there was no manual location entry by the user at block 570, then at block 575 another session termination event may occur. Session termination events may include a "log out" or similar instruction from the user, the closing of a user interface, or may occur on the lapse of a period of time, or the like.

After block 585, the process may return to FIG. 4, which may, in turn, return to FIG. 5.

Figure 6:
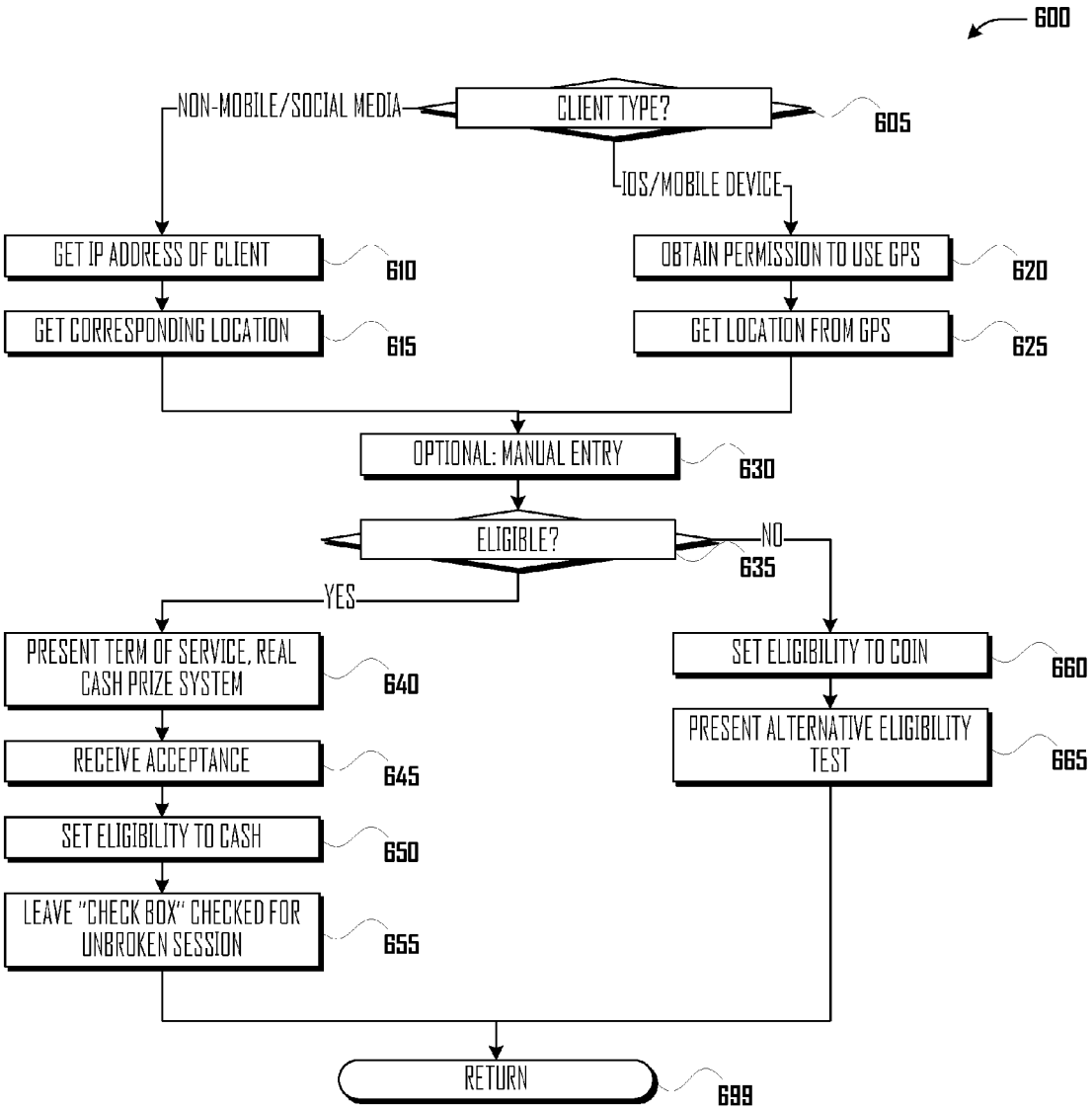
FIG. 6 is a flowchart illustrating a detail of an Eligibility Routine, as may be practiced within the User Contact Routine 500 illustrated in FIG. 5.

FIG. 6 is a flowchart illustrating a detail of an Eligibility Routine, as may be practiced within the User Contact Routine 500 illustrated in FIG. 5, by, for example, the Game Server 200. At block 605, an initial determination may be made regarding the type of Client Device which the Game Server 200 is communicating with. Non-mobile Client Devices and/or Client Devices coming through or from a social media service proceed to block 610. At block 610, the IP address of the Client Device is obtained and at block 615 a location corresponding to the IP address may be obtained; locations associated with IP addresses may be obtained from public databases, such as databases maintained by the Internet Assigned Numbers Authority or delegates thereof, such as AfriNIC, APNIC, ARIN LACNIC, and RIPE NCC or by third parties. Client Devices which are Mobile Devices (such as Mobile Device 110) proceed to block 620. At block 620, permission may be obtained from the Client Device to obtain the location of the Client Device based on GPS equipment in the Client Device. At block 625, the location may be obtained from the GPS equipment in the Client Device.

At block 630, the user may optionally be requested to manually provide the user's address, such as by filling out a form. The user's manual entry of location may take precedence over the user's location as determined from IP address or GPS. The user's manual location entry may occur at a different time, such as during an initial log-in step, while the GPS and/or IP address checks may occur during a Prize Hub Session load, such as at block 530. At block 635, a determination may be made regarding whether the address provided by the Client Device, whether via IP address, GPS location, or manual entry is eligible for monetary rewards or only non-monetary rewards. This determination may be made by looking up the location in the Location Status 335 records. If eligible for monetary rewards, then at block 640 the terms of service for the monetary-based rewards may be presented to the Client Device. At block 645 acceptance of the terms of service may be received and, at block 650, the user's eligibility may be set to indicate eligibility for monetary rewards. This eligibility may be set in the User Eligibility 320 record. At block 655 a "check box" or similar may be communicated to the user, which check box may be left "checked" or similar to indicate that the user will have an unbroken session based on the eligibility determined at block 635.

Otherwise, if in decision 635 the Eligibility Routine 600 determines that the user was eligibly only for non-monetary rewards, at block 660 the user's eligibility may be set to indicate eligibility for non-monetary rewards. This eligibility may be set in the User Eligibility 320 record. At block 665, an alternative eligibility test may be communicated to the user; an alternative eligibility test may involve manual entry of an address, mailing a letter to a physical location, or similar.

At block 699, the process returns to FIG. 5.

FIG. 7 is a flowchart illustrating a detail of a Game Play Routine, as may be practiced within the User Contact Routine 500 illustrated in FIG. 5, by, for example, the Game Server 200. At block 705, a request or similar from the user has been received to enter the user in a Game, such as roulette. At block 710 the requested Game may be executed and, at block 715, credits or "Coins" required to play the Game, including any bets made by the user as part of the Game, may be debited from the user's account, as may be noted in the User Account 315 records. At block 720, a determination may be made regarding whether the user won the Game, a round or hand in the Game, a bet (including a single-spin bet or a sidebet) which the user entered in relation to the Game. If not at block 720, the process may proceed to block 799 and may return to FIG. 6; if yes at block 720, then at block 725 credits or Coins may be awarded to the user according to the criteria for the Game and, at block 800, the Ticket Award Routine 800 may be executed and may award tokens good for entering a Sweepstakes, also referred to herein as "Tickets," to the user, after which the process may proceed to block 799 and may return to FIG. 6.

Figure 8:
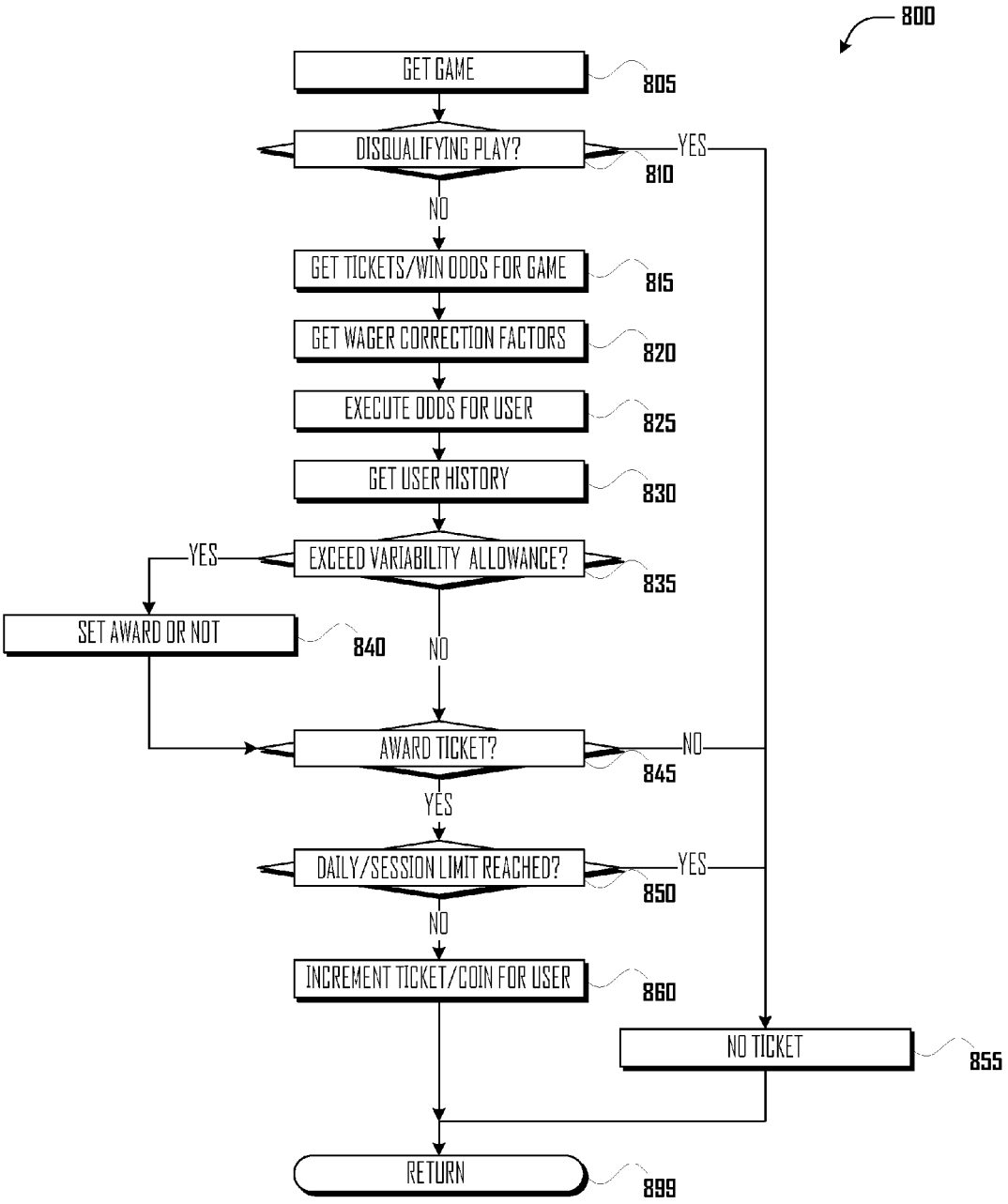
FIG. 8 is a flowchart illustrating a detail of a Ticket Award Routine, as may be practiced within the Game Play Routine 700 illustrated in FIG. 7.

FIG. 8 is a flowchart illustrating a detail of a Ticket Award Routine, as may be practiced within the Game Play Routine 700 illustrated in FIG. 7, by, for example, the Game Server 200. At block 805, the Game which the user was playing may be obtained. Different Games have different play rules, which may be recorded, for example, in the Games 330 records. At block 810, a determination may be made regarding whether the user's play in the Game disqualified the user from receiving a Ticket. Non-limiting examples of disqualifying play would be betting on red and black, even and odd, or 1 through 18 and 19 through 26 simultaneously in roulette, or other strategies which reduce the required bet or unacceptably increase the odds of winning. The user's play in the Game may be obtained from the User History 310 records. If disqualifying play was determined, then at block 855, no Ticket is awarded, which event may not be communicated to the user but may be noted in the User History 310 records.

If no disqualifying play was determined, then at block 815, the odds of winning a ticket for the Game may be obtained, for example, from the Ticket Win Odds by Game 340 records. At block 820, a correction factor based on the user's wager in the Game may be obtained, for example, from the Ticket Win Odds by Game 340 records. For example, wagering a larger amount may increase the odds of winning a Ticket. At Block 825 the odds and the correction factor of block 820 are executed to determine if the user may be awarded a Ticket. At block 830, the user's history may be obtained, such as from the User History 310 records. At optional block 835 a determination may be made regarding whether a variability allowance relative to the user and Ticket awards has been exceeded. The variability allowance may prevent a user from receiving or not receiving Tickets within a period or over a number of potential Ticket award circumstances. For example, if a user has not been awarded a Ticket the last four times that the user has won a Game, then the variability allowance may be determined to have been exceeded; similar variability allowance thresholds may be set for being awarded Tickets, as well, to prevent excessive Ticket awards. At block 840, the Ticket may be awarded or not based on the variability allowance having been exceeded. At block 845, the variability allowance was not determined to have been exceeded (or it was exceeded and the Ticket was awarded or not or no variability allowance was employed) and a determination may be made regarding whether a Ticket is awarded to the user.

If a Ticket was awarded to the user, then at block 850 an optional determination may be made regarding whether a limit has been reached in terms of a number of Tickets to be awarded to any user in a day or session. If the limit was found not to have been reached at block 850 (or if no Ticket limit was utilized), then at block 860, the Tickets for the user may be incremented to reflect the Ticket award, such as in the User Account 310 records and/or the User History 310 records. If the limit was found to have been reached at block 850, then at block 855 no Ticket award may be noted such as in the User History 310 records. At block 899 the process may return to FIG. 5.

FIG. 9 is a flowchart illustrating a detail of a Team Routine, as may be practiced within the User Contact Routine 500 illustrated in FIG. 5, by, for example, the Game Server 200. At block 905, the user's history may be obtained, such as from the User History 310 record. At block 910, a determination may be made regarding whether the user is presently part of a Team; this determination may be made by reference to, for example, the Team 350 record. If the determination at block 910 is negative (if the user is not then currently part of a Team), then at block 915 a determination may be made, based on the user's history, regarding whether the user meets criteria to originate a Team. Such criteria may be, for example, whether the user has logged into the User Contact Routine 500 more than a certain number of times within a time period, whether the user has completed steps, such as a new user orientation, or other criteria.

If the determination at block 915 was affirmative, then at block 920 a selection lottery may be performed to determine if the user will be invited to originate a Team. At block 925 a determination may be made regarding whether the user was selected to be invited to originate a Team.

If the determination at block 925 was affirmative, then at block 930, the Team Type for the Team may be selected by the user and/or by the operator of the Game Server 200. The Team Type may be selected from among Team Type 345 records. The Team Types may represent, for example, Teams in which all Team members receive the same number of credits and/or Tickets, in which one or more Team members (such as the Team Originator) receive more credits and/or Tickets than other Team members, in which Team members must each separately achieve objectives in order to the Team to complete its objective or whether the Team members must collectively achieve objectives; Team or individual objectives may comprise Game play, a time period of activity with the Game Server 200, Game wins, Ticket wins, point, Coin, or credit wins, and similar. At block 935, the objective(s) to be achieved by the Team and the reward to be earned by the Team for completion of the objective(s) may be set. The reward may be, for example, a number of credits or Coins and/or a number of Tickets.

At block 940 the user may be presented with the enrollment opportunity, allowing the user to originate the Team, and a count-down clock may be started, which count-down clock may define the time period during which the Team may be formed. At block 945, a determination may be made regarding whether the count-down clock for formation of the Team has finished. If not, then at block 950, an enrollment (agreeing to originate the Team) may be received from the user. At block 955, the user submits and the Team Routine 900 receives the friends whom the user wishes to invite to join the Team; this information may include identifiers of the friends (such as identifiers used in social media services) and/or other contact information for the friends. The friends and/or contact information for them may be stored, for example, in the Friends 325 records. At block 960, the friends may be invited by the Team Routine 900 to join the Team, such as by sending messages to the friends. At block 965 a determination may be made regarding whether all or a minimum number of friends have accepted the invitation to join the team. The Team may or may not require a minimum number of participating Team members. When all or a minimum number of required Team members have joined the Team (if required), then at block 970 messaging may be communicated to the Team (which messaging may include credits and/or Tickets for forming the Team) and, at block 975, a count-down clock may be started relative to achievement of the Team objectives.

At block 980 a determination may be made regarding whether the count-down clock relative to the Team objective (s) has expired. If it has not expired, then at block 985 a determination may be made regarding whether the Team objective has been achieved. If it has not, then the process may return to block 980. If it has, then the process may proceed to block 990 where the Team's reward, comprising credits, Coins, and/or Tickets, are awarded to the Team members according to the Team Type 345, such as by updating the User Account 315 records of the Team members (with messaging to the users).

Following block 990, or block 980 if the objective clock expired, or following block 945 if the Team formation clock expired, the process may then proceed to block 999 and may return to FIG. 5.

FIG. 10 is a flowchart illustrating a detail of the Sweepstakes Entry Routine, illustrated in FIG. 5, which routine may be performed by, for example, the Game Server 200. At block 1005, the parameters for the next Sweepstakes may be obtained; the Sweepstakes may be operated on an hourly, daily, weekly, or monthly basis, with different awards for different Sweepstakes. More than one Sweepstakes may be open at any one time (such as, for example, a weekly and a monthly Sweepstakes). The parameters for the Sweepstakes may specify, for example, the time period for entering into the Sweepstakes, the reward of the Sweepstakes, and the cost, in Tickets or other consideration, to enter the Sweepstakes. The cost in Tickets to enter a Sweepstakes may be a set number of Tickets or may be calculated based on the reward of the Sweepstakes and a ratio of Tickets to reward, such as one Ticket for each $2500 in reward, rounded to the nearest whole Ticket cost. The Sweepstakes parameters may be obtained, for example, from the Sweepstakes 355 records. At block 1010 a count-down clock for entering the Sweepstakes may be initiated (based on the parameters from block 1005). At block 1015, a determination may be made regarding whether the count-down clock for entering the Sweepstakes has expired. If not, then at block 1020, the entry cost (in Tickets or other consideration) and other information relating to the Sweepstakes is served to the Client Device for display or communication to the user. At block 1025 a user contact may be received, which user contact indicates a desire to enter the Sweepstakes. At block 1030 the user history may be obtained, such as from the User History 310 records. At block 1035 manual validation forms may be presented to the user requesting, for example, the user's location and/or residence.

At block 1040, a determination may be made regarding whether the user is eligible to enter the Sweepstakes. The user may be ineligible due to a stated or determined location and/or residence. If the user in ineligible, then at block 1060 the user may not be entered in the Sweepstakes; this may be communicated to the user. If the user is eligible to participate in the Sweepstakes, then at block 1045 a determination may be made regarding whether the user has exceeded an entry limit, such as that the user may only enter 10 Sweepstakes per day or a different number of entries per another time period. If the user has not exceeded the entry limit, then at block 1050 the user may be entered in the Sweepstakes; this may be communicated to the user. At block 1055 the user's account may be debited the consideration required to enter the Sweepstakes, such as a number of Tickets. This transaction may be noted in, for example, the User Account 315 records and/or User History 310 records. At block 1065 the process may return to block 1015 to determine if the entry clock for the Sweepstakes has run. At block 1099, which is encountered when the Sweepstakes entry clock has expired, the process may return to FIG. 5.

Figure 11:
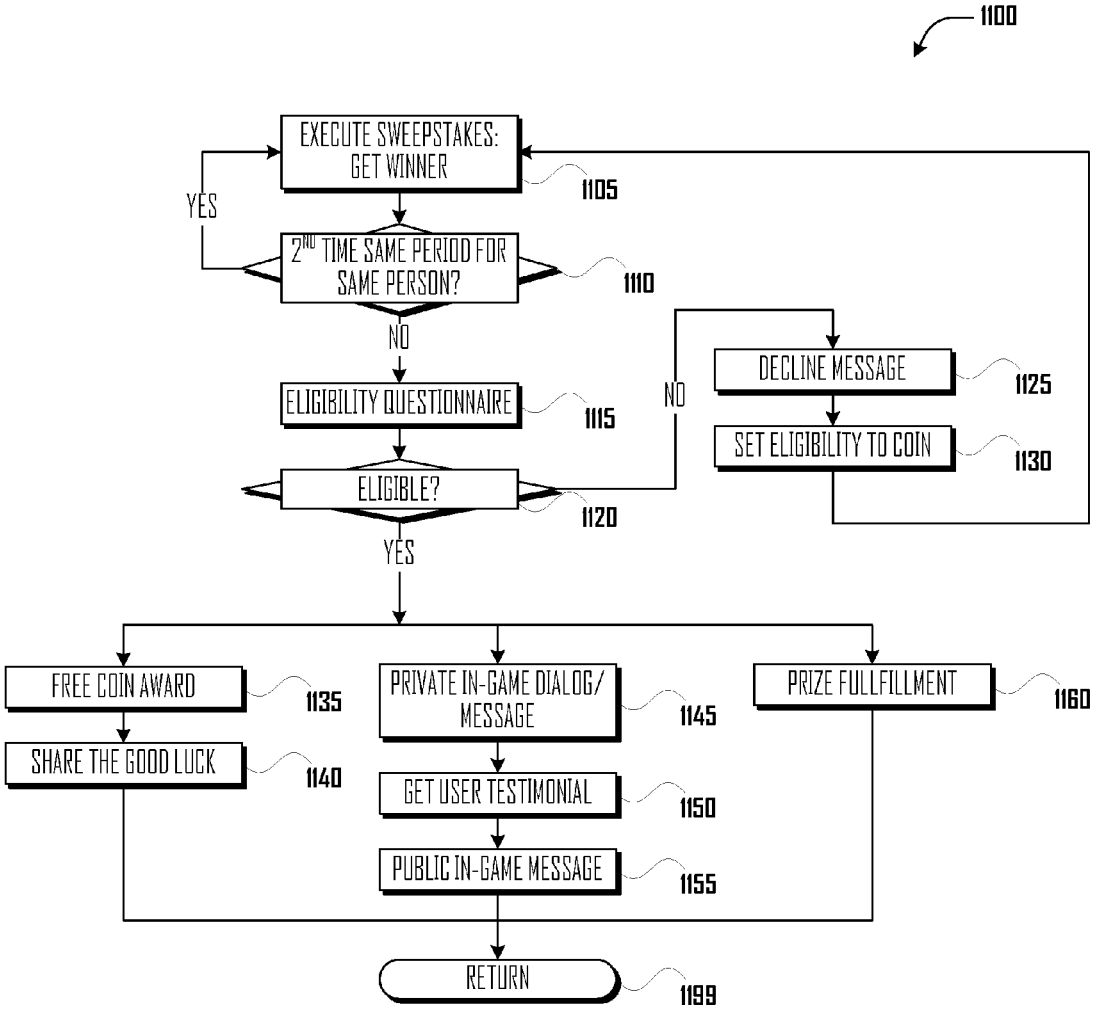
FIG. 11 is a flowchart illustrating a detail of the Sweepstakes Routine, illustrated in FIG. 4.

FIG. 11 is a flowchart illustrating a detail of the Sweepstakes Routine, illustrated in FIG. 4, which routine may be performed by, for example, the Game Server 200 and/or the Prize Fulfillment Server 130 (the Game Server 200 may perform certain of these steps, while the Prize Fulfillment Server 130 may perform other of these steps). At block 1105, the Sweepstakes is executed (which may be performed by a third party, such as the Prize Fulfillment Server 130) and the winner of the Sweepstakes is obtained. At block 1110 a determination may be made regarding whether the winner of the Sweepstakes is the same user for the second time within a period. For example, if a user wins a daily Sweepstakes for the second time in a day (or within another period), then the user may be disqualified from winning again. If this occurs, then the process may return to block 1105 to re-execute the Sweepstakes to determine a different winner.

At block 1115 an eligibility questionnaire may be communicated to the user. The eligibility questionnaire may include questions regarding the user's location and/or residence, whether the user is employed by a party offering the Sweepstakes, and similar. At block 1120, a determination may be made regarding whether the user is eligible according to the responses to the eligibility questionnaire. If the user is found to be ineligible, then at block 1125 a message may be communicated to the user that the user is not eligible to participate in the Sweepstakes and the user's eligibility may be set to credit (or "Coin"), as may be recorded, for example, in the User Eligibility 320 record. Following this, the process may return to block 1105 to re-execute the Sweepstakes to determine a different winner.

If at block 1120 the user was found to be eligible, then at optional block 1135 additional credits may be allocated and, at block 1140, the user may be invited to "share the good luck" by, for example, sending messages to others, which messages allow the recipients of the messages to claim some or all of the additional credits allocated at block 1135. At an optional block 1145, a private dialog may communicate the Sweepstakes win to the user, may, at block 1150, get a testimonial or other statement from the user. At block 1155 a public message may be communicated to all users indicating that the Sweepstakes was won and by who. At block 1160 the reward may be fulfilled, such as by sending instructions to redeem the reward to the user. At block 1099, the process may return to FIG. 4.

The above Detailed Description of embodiments is not intended to be exhaustive or to limit the disclosure to the precise form disclosed above. While specific embodiments of, and examples are described above for illustrative purposes, various equivalent modifications are possible within the scope of the system, as those skilled in the art will recognize. For example, while processes or blocks are presented in a given order, alternative embodiments may perform routines having operations, or employ systems having blocks, in a different order, and some processes or blocks may be deleted, moved, added, subdivided, combined, and/or modified. While processes or blocks are at times shown as being performed in series, these processes or blocks may instead be performed in parallel, or may be performed at different times. Further, any specific numbers noted herein are only examples; alternative implementations may employ differing values or ranges.

The invention claimed is:

1. A method of providing gaming services in a computer comprising a memory, comprising:

receiving at the computer a contact from a client computer;

determining at the computer if a human user of the client computer is eligible to participate in a sweepstakes only for non-monetary rewards or otherwise that the human user of the client computer is eligible to participate also in a sweepstakes in which money can be won, wherein the determining if the human user of the client computer is eligible to participate comprises obtaining GPS location information from GPS equipment in the client computer and determining if the location from the GPS location information is a location that allows monetary rewards for sweepstakes participants;

serving by the computer a gaming user interface with reward elements dependent upon the determination of the human user's reward eligibility to the client computer;

determining at the computer that the human user has won a round in a game involving a wager in the gaming user interface and providing the human user with a sweepstakes token for entering a determined sweepstakes, the determined sweepstakes being either the sweepstakes for the non-monetary reward or the sweepstakes in which the money can be won dependent upon the determination of the human user's reward eligibility;

receiving at the computer a second contact from the client computer and entering the human user in the determined sweepstakes based on the second contact;

executing the determined sweepstakes; and determining that the human user won the determined sweepstakes.

2. The method according to claim 1, further comprising offering the human user the opportunity to participate in a team to complete a team challenge to earn one or more sweepstakes tokens on completion of the team challenge.

3. The method according to claim 2, wherein the team comprises friends of the human user, which friends are obtained from a social media service.

4. The method according to claim 2, further comprising associating the human user with the team and the team challenge.

5. The method according to claim 2, wherein offering the human user the opportunity to participate in the team further comprises selecting a Team Type, a number of tokens to be earned by the team for completion of the team challenge, and starting a count-down clock for a period of time during which period of time the human user may elect to participate in the team.

6. The method according to claim 5, wherein the Team Type determines how the tokens earned by the team for completion of the team challenge are divided among the team members and wherein a first Team Type determines that the tokens may be divided equally among the team members and a second Team Type determines that the one member of the team receives more tokens than the other members of the team.

7. The method according to claim 1, wherein providing the human user with the sweepstakes token further comprises obtaining odds for winning the token, which odds are associated with the game, and executing the odds relative to the human user.

8. The method according to claim 7, further comprising obtaining the human user's play frequency and adjusting the odds for winning the token in an inverse proportion relative to the human user's play frequency.

9. The method according to claim 7, further comprising obtaining a wager made by the human user in the game involving a wager and adjusting the odds for winning the token in proportion to the wager made by the human user.

10. The method according to claim 7, further comprising obtaining the human user's history in the gaming services computer and determining whether the human user has or has not exceeded a variability allowance relative to tokens awarded or not awarded in the past and awarding the token or not based on the determination relative to the variability allowance.

11. The method according to claim 7, further comprising determining that the human user has not reached a limit for the award of the token within a time period.

12. The method according to claim 1, wherein determining the human user's eligibility comprises determining an IP address associated with the client computer, looking up a location associated with the IP address, and determining if the location is a location which allows monetary rewards for sweepstakes participants.

13. The method according to claim 1, wherein determining the human user's eligibility comprises obtaining GPS location information from the client computer, and determining if the location from the GPS location information is a location which allows monetary rewards for sweepstakes participants.

14. The method according to claim 1, wherein the human user is determined to be eligible to participate in a sweepstakes with the potential for a monetary reward.

15. The method according to claim 14, wherein the human user's eligibility expires after a period of time.

16. The method according to claim 15, wherein the period of time is 24 hours.

17. The method according to claim 1, further comprising determining whether the human user previously won the sweepstakes within a disqualification time period.

18. The method according to claim 1, further comprising performing another determination regarding whether the human user of the client computer is eligible to participate in the sweepstakes for a monetary or a non-monetary reward.

19. The method according to claim 1, further comprising determining an IP address associated with the client computer, looking up a location associated with the IP address, and determining if the location is a location which allows monetary rewards for sweepstakes participants, and determining that the human user's eligibility has changed based on the determined location.

20. A computing apparatus for providing gaming services, the apparatus comprising a processor and a memory storing instructions that, when executed by the processor, configure the apparatus to:

receive a contact from a client computer;

determine if a human user of the client computer is eligible to participate in a sweepstakes only for non-monetary rewards or otherwise that the human user of the client computer is eligible to participate also in a sweepstakes in which money can be won, wherein the determining if the human user of the client computer is eligible to participate comprises obtaining GPS location information from GPS equipment in the client computer and determining if the location from the GPS location information is a location that allows monetary rewards for sweepstakes participants;

serve a gaming user interface with reward elements dependent upon the determination of the human user's reward eligibility to the client computer;

determine that the human user has won a round in a game involving a wager in the gaming user interface and providing the human user with a determined sweepstakes that is either the sweepstakes for the non-monetary reward or the sweepstakes in which the money can be won dependent upon the determination of the human user's reward eligibility; and receive at the computer a second contact from the client computer and entering the human user in the determined sweepstakes based on the second contact.

* * * * *